United States Patent [19]

Campbell

[11] Patent Number: 4,693,292

[45] Date of Patent: Sep. 15, 1987

[54] CASTING OF METAL ARTICLES

[75] Inventor: John Campbell, Worcester, United Kingdom

[73] Assignee: Cosworth Research and Development Limited, Birmingham, Great Britain

[21] Appl. No.: 826,870

[22] PCT Filed: Jun. 3, 1985

[86] PCT No.: PCT/GB85/00235

§ 371 Date: Jan. 21, 1986

§ 102(e) Date: Jan. 21, 1986

[87] PCT Pub. No.: WO85/05583

PCT Pub. Date: Dec. 19, 1985

[30] Foreign Application Priority Data

Jun. 2, 1984 [GB] United Kingdom ..... 8414129

[51] Int. Cl.[4] ..... B22C 9/04; B22C 9/08; B22D 18/04

[52] U.S. Cl. ..... 164/34; 164/119

[58] Field of Search ..... 164/34, 35, 36, 119

[56] References Cited

U.S. PATENT DOCUMENTS

| | | | |
|---|---|---|---|
| 3,259,949 | 7/1966 | Moore . | |
| 3,532,154 | 10/1970 | Balevski et al. | 164/119 |
| 3,635,791 | 1/1972 | Bly et al. | 164/335 X |
| 3,727,674 | 4/1973 | Chatourel et al. | 164/119 X |
| 3,771,588 | 11/1973 | Cavanagh . | |
| 4,003,424 | 1/1977 | Hetke et al. . | |
| 4,222,429 | 9/1980 | Kemp . | |

FOREIGN PATENT DOCUMENTS

| | | | |
|---|---|---|---|
| 631205 | 8/1963 | Belgium . | |
| 0152754 | 8/1985 | European Pat. Off. . | |
| 1239437 | 4/1967 | Fed. Rep. of Germany | 164/34 |
| 1602169 | 11/1970 | France | 164/119 |
| 2177466 | 11/1973 | France . | |
| 2295808 | 7/1976 | France . | |
| 40-5408 | 3/1965 | Japan | 164/119 |
| 44-10761 | 5/1969 | Japan | 164/34 |
| 56-1244 | 1/1981 | Japan | 164/34 |
| 1063543 | 3/1967 | United Kingdom . | |
| 1171295 | 11/1969 | United Kingdom . | |
| 1219779 | 1/1971 | United Kingdom . | |
| 1386803 | 3/1975 | United Kingdom . | |
| 1388773 | 3/1975 | United Kingdom . | |
| 1434516 | 5/1976 | United Kingdom . | |
| 1524550 | 9/1978 | United Kingdom . | |
| 2035165A | 6/1980 | United Kingdom . | |
| 1598385 | 9/1981 | United Kingdom . | |
| 2113587A | 8/1983 | United Kingdom . | |

*Primary Examiner*—Gene P. Crosby
*Assistant Examiner*—J. Reed Batten, Jr.
*Attorney, Agent, or Firm*—Marshall, O'Toole, Gerstein, Murray & Bicknell

[57] ABSTRACT

A method of casting metal articles by feeding molten metal upwardly against the force of gravity from a source of molten metal into a mould cavity where the metal is permitted to solidify within the cavity after which the metal feed is interrupted and the casting is removed from the cavity. The mould cavity is made by embedding an in situ destroyable pattern in particulate moulding material to form a mould cavity. The pattern may be destroyable in situ by the heat of the metal as it is fed into the mould cavity or by applying heat prior to feeding the metal into the cavity. The source of metal may be a reservoir located at a level below the level of the cavity with a pump to pump metal upwardly into the cavity through a riser tube. The metal to be cast may be supplied to the reservoir in molten state or in solid state and melted in the reservoir.

14 Claims, 4 Drawing Figures

CASTING OF METAL ARTICLES

BACKGROUND OF THE INVENTION

1. Field of the Invention

This invention relates to the casting of metal articles. More particularly, it relates to the casting of metal articles in which molten metal is poured into a mould cavity formed in particulate material by destroying a pattern in situ.

2. Description of the Prior Art

One well known example of such a casting method comprises embedding a pattern of foam plastics material, e.g. expanded polystyrene, in binder-free foundry sand, consolidating the sand to form a mould, pouring molten metal into the mould to destroy the pattern by burning or vaporising the pattern so that the metal replaces the pattern and an article corresponding to the original shape of the pattern is cast in the mould cavity previously occupied by the pattern.

Such a method has a number of advantages which include:

1. the ability to produce castings without joint lines and thus with reduced flash thereby requiring less fettling than with conventional moulds comprising cope and drag parts;

2. the process is relatively easy to automate since moulding involves simple filling of particulate material around the pattern using dry binder-free particulate material such as foundry sand;

3. knock-out and de-coring are easy since the unbonded particulate material simply runs off and out of the casting.

However, it suffers from the disadvantage of sporadic filling defects which are unacceptable in castings which are safety critical, such as suspension and steering components for automobiles.

SUMMARY OF THE INVENTION

It is accordingly an object of the present invention to provide a method of casting metal articles whereby the above mentioned problem is overcome or is reduced.

According to the broadest aspect of the present invention I provide a method of casting metal articles comprising the steps of feeding molten metal generally upwardly against the force of gravity from a source of molten metal into a mould cavity, permitting the metal to solidify within the cavity, interrupting the feed of said metal and removing the casting from the mould.

According to a first more specific aspect of the invention, the method may include the step of embedding an in situ destroyable pattern in particulate moulding material to form a mould cavity therein.

The pattern may be destroyed in situ by the heat of the metal as it is fed into the mould cavity.

Alternatively the pattern may be destroyed in situ prior to feeding the metal into the mould cavity.

The pattern may comprise a casting part to provide a casting portion of the cavity and an ingate part to provide a casting ingate portion of the cavity.

The pattern may also be provided with a runner system part to provide a runner system portion of the cavity and a runner ingate part to provide a runner ingate portion of the cavity.

Metal may be fed from the source into the mould through an orifice in a mould base on which the mould is supported.

The casting ingate part of the pattern may be disposed in casting relationship with the orifice in the mould base and then the particulate material is introduced around the casting part and casting ingate part to embed the pattern within the particulate material.

The runner ingate part of the pattern may be disposed in casting relationship with an orifice in the mould base and then the particulate material is introduced around the casting part and runner system and runner ingate parts to embed the pattern within the particulate material.

The pattern may be disposed within a peripheral wall extending upwardly from a mould base to provide a mould box into which the particulate material is introduced to embed the pattern therein.

The pattern may be coated with one or more washes, for example an aqueous ceramic slurry, to support the mould during the casting process, followed by drying.

The particulate material in which the pattern is embedded may be compacted by vibration or the application of a vacuum, or by other means, or by a combination of such means.

According to either the broadest aspect of the invention or the first more specific aspect of the invention, the source of metal may be a reservoir of metal located at a level which is below the level of the cavity with a pump being provided to pump metal upwardly from the reservoir into the cavity through a riser tube.

The metal may be pumped into the cavity at the bottom thereof.

According to a second more specific aspect of the invention, the features of which may be provided together with, or instead of, the features of the first more specific aspect, the metal to be cast may be supplied to the reservoir by feeding metal in solid state therein to, and melting the metal in the reservoir.

The reservoir may have a feed region whereat said metal is fed into the reservoir in solid state, and a casting region from which metal, in liquid state, is drawn by said pump.

The reservoir may have a heating region, between the feed region and the casting region in which heat is applied to the metal in the reservoir.

According to the broadest aspect or the first more specific aspect of the invention, the metal to be cast may be supplied to the reservoir in molten state from a source of molten metal separate from the reservoir.

The metal may be supplied to the reservoir by means of a ladle.

The metal may be supplied to the reservoir by means of a launder.

The metal may be supplied to the reservoir from a melting furnace separate from the reservoir.

According to the first or second more specific aspect of the invention, the metal may be pumped by an electro-magnetic pump or by a fluid pressure pump.

Alternatively the metal may be pumped by providing the reservoir within a sealed housing and pressurising the interior of the housing to force metal upwardly through a riser tube extending from below the level of metal in the reservoir through the housing.

After the metal has solidified, the level of metal in the riser tube may be lowered below the level of the entry to the mould and thereafter the mould and casting are removed from casting relationship with the source of metal, together with the mould base.

The mould may be made of particulate material and the casting may be removed from the mould by tipping out the particulate material or by fluidising the particulate material or by any other desired means.

After removal of the casting from the mould, the ingate and any other running system and feeding system, if present, may be removed from the casting.

The mould may be made of particulate moulding material which comprises any one or a number of a variety of foundry sands, including silica, olivine, chromite, zircon, chamotte, quartz, or synthetic material such as silicon carbide or iron or steel shot.

The particulate moulding material may comprise a ferro-magnetic material and the particulate material is compacted by the use of a magnetic field.

A pressure below atmospheric pressure may be applied to the mould during casting to assist consolidation and/or removal of vapour or other decomposition products of the pattern.

The mould cavity may be filled by a flow of metal generally upwardly against the force of gravity throughout the mould cavity.

The mould cavity may be filled without any substantial flow of the metal downwardly under the influence of gravity within the mould cavity.

The metal may be fed into the mould cavity by a low pressure delivery system, which causes a differential pressure to exist between the pressure in the mould cavity and the pressure in the source of molten metal.

Said differential pressure may be in the range 0.1 to 1.0 atmospheres and preferably 0.20 to 0.70 atmospheres.

The mould cavity may comprise at least one casting portion, in which a final casting is produced, and metal is fed to the casting portion at a single location and the casting portion is designed so that no part thereof is fed from another part of the casting portion along a path having any substantial flow downwardly under the influence of gravity.

The mould cavity may comprise at least one casting portion, in which a final casting is produced, and metal is fed into the casting portion at a plurality of locations so that the casting portion is filled by generally upward flow of metal from a plurality of locations against the force of gravity without any substantial flow of metal downwardly under the influence of gravity.

The mould cavity may include a casting ingate portion which communicates directly with the casting portion.

The casting ingate portion of the cavity may communicate with a runner system portion of the cavity which is provided with a runner ingate portion of the cavity which communicates with the source of metal.

The casting ingate portion may communicate with a source of metal without any runner system.

The ingate may be placed in casting relationship with the orifice in the mould base by inserting a portion of the ingate part of the pattern into close fitting engagement within the orifice.

The orifice may be lined with, or integrally formed in, thermally insulated refractory material capable of withstanding the liquid metal to be cast.

The orifice may be reused for a plurality of castings.

Alternatively the orifice may be disposed after each casting operation.

The orifice may be formed as an insert in the mould base.

The orifice may be placed in casting relationship with the source of metal and a feed is effected by the use of a ceramic fibre gasket between a riser tube extending from the source of metal and the member in which the orifice is formed.

Said feeding of molten metal generally upwardly against the force of gravity from the source of molten metal into the mould cavity may be performed without any substantial flow of metal downwardly under the influence of gravity between the source and the entry into the cavity.

The filling defects encountered with the previously known process mentioned above arise because of the action of the liquid metal whilst it falls downwards under gravity. The uncontrolled tumbling, splashing, surging etc., introduces and entraps oxides, gases and decomposition products from the pattern and mould materials into the metal. Even when the flow is more gentle, cool streams of metal develop a carbon deposit from decomposing styrene vapour, which prevents two such streams from effectively merging in parts of the casting.

By feeding metal upwardly against the influence of gravity as called for by my invention, I have found that the above mentioned problem is overcome or reduced because the gentle rise of the substantially horizontal metal surface keeps the metal separate from the unmixed with the decomposable pattern and its decomposition products since decomposition of the pattern occurs progressively ahead of the advancing metal surface.

By an "in situ destroyable pattern", I mean a pattern which, when in a solid state, is sufficiently strong to enable the particulate material to be formed therearound and which can be destroyed in situ so as to leave a mould cavity. For example, the pattern may be destroyed in situ by being at least substantially completely transformed to the gaseous state, whilst within the particulate material, by subjecting the pattern to heat to cause it to vaporise and/or burn and/or undergo some other heat initiated chemical reaction. One example of a suitable destroyable pattern is a pattern made of expanded polystyrene which is decomposed by combustion substantially to the gaseous state on heating. Of course some of the decomposition products may be small solid particles such as soot but these can leave the mould cavity together with the gaseous products of combustion, for example by passing through the pores between the particles of the particulate material. Although it is preferred that the pattern is destroyed in situ by utilising the heat of the molten metal as it is cast into the mould, if desired, the pattern may be predestroyed in situ, for example, by applying heat to the pattern prior to casting.

BRIEF DESCRIPTION OF THE DRAWINGS

Two embodiments of the invention will now be described by way of example, with reference to the accompanying drawings, wherein.

DESCRIPTION OF THE PREFERRED EMBODIMENT

Figure 1:
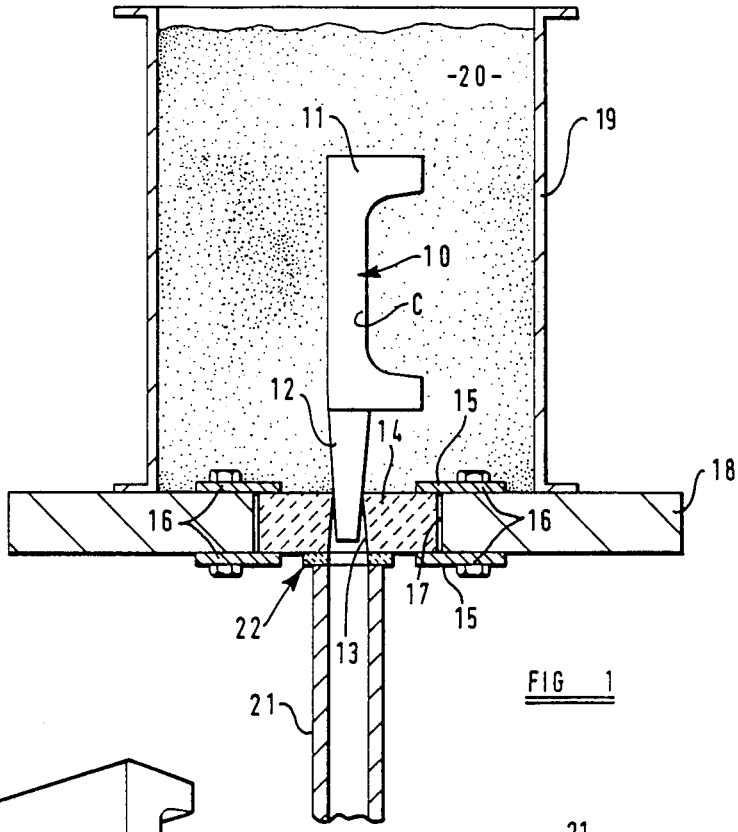
FIG. 1 is a diagrammatic cross-sectional view through part of an apparatus for performing the method embodying the present invention.
Figure 2:
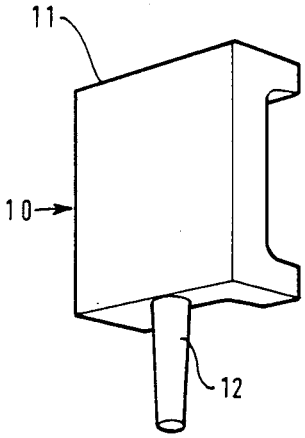
FIG. 2 is a perspective view of the pattern for the casting and ingate shown in FIG. 1.

Referring to the drawings, a pattern made of expanded polystryene is indicated at 10 and comprises two parts namely a casting part 11 of a desired shape of the final casting to be produced, and a casting ingate prt 12. The pattern 10 is made in conventional manner by introducing polystyrene granules into a moulding machine where they are injected into a die of the desired configuration. Steam is then injected which causes the granules to expand and fuse together. The resultant expanded polystyrene pattern is then water cooled and ejected from the die.

Although in the example illustrated the pattern is a one-piece moulding with the casting parts 11 and 12 integral with each other, depending upon the shape of the final casting and ingate or ingate and runner system, the pattern may be moulded in two or more separate parts bonded together by a suitable adhesive or other means.

The pattern is then stored so that the normal pattern shrinkage occurs prior to use of the pattern. Of course, the die in which the pattern is made is correspondingly larger size to allow for the shrinkage both of the pattern and of the final casting.

The pattern is then coated with an aqueous refractory slurry by dipping or spraying and allowing to dry.

The pattern 10 is then positioned so that the ingate part 12 is in close fitting engagement with a cylindrical orifice 13 formed in an insert 14 made of suitable insulating refractory material such as a lightweight refractory cement, removably mounted by plates 15 secured in position by bolts 16 in an aperture 17 of a mould base board 18. An open bottomed and topped container 19 is then positioned on top of the mould base 18 and particulate moulding material 20 poured into the container 19 around the pattern 10 so as to embed the pattern 10 in the particulate material 20 and form a mould cavity C therein.

In the present example, the particulate material comprises zircon sand but may be any other suitable particulate material, such as silica, olivine, chromite, chamotte, quartz sand or synthetic material such as silicon carbide or iron or steel shot.

In the present example, the particulate material is then consolidated around the pattern 10 by vibrating the assembly of mould base 18, container 19 etc., but it may be consolidated by any other suitable means such as the application of suction to the interior of the mould material, or by other means or by a combination thereof.

The mould base 18 carrying the moulding material 20 and pattern 10 therein is then positioned in casting relationship with a conventional low pressure casting machine M so that a riser tube 21 of the machine is placed in sealing engagement with the insert 14 with a ceramic fibre gasket 22 therebetween to provide a liquid-tight seal.

The low pressure die casting machine M comprises a furnace 23 having electrical heating elements 24 containing a sealed reservoir 25, to which molten metal is fed from a separate melting furnace by means of, for example, a ladle. If desired the molten metal may be fed by other means such as a launder. After filling with molten metal the reservoir 25 is sealed and the machine M is then operated by pressurising the reservoir 25 in conventional manner by applying gas, e.g. air or nitrogen, under pressure, e.g. 0.2 to 0.7 atmospheres, via conduit 26 so as to force metal up the riser tube 21 to cast molten metal into the mould cavity C. In the present example, the metal is an aluminium alloy, but may be other metals such as aluminium, magnesium, copper and alloys based on such metals, cast iron or steel. The molten metal is fed by the casting machine through the riser tube 21 and into the orifice in the insert 14 where the heat of the metal causes progressive decomposition of the ingate part 12 and casting part 11 so that the pattern 10 is destroyed by being decomposed into gas and/or small solid or liquid particles which escape from the resultant cavity through the pores between the particles of particulate material 20. Thus, the molten metal occupies the mould cavity C in the granular material 20 which was previously occupied by the pattern 10. The refractory coating provided by the slurry supports the moulding material during casting and provides the cavity with a good surface finish.

If desired, a partial vacuum may be applied to the mould during at least the initial stages of feeding metal into the mould to assist with consolidation and/or removal of vapour or other decomposition products of the pattern.

After the mould cavity C has been filled with liquid metal, the metal is allowed to solidify, or at least solidify to the extent so as to be self-supporting. Pressure is then released or partially released to allow the metal to fall back or partially fall back from the level of the ingate down the riser tube into the reservoir, and then the mould and the casting therein are removed out of casting relationship with the casting machine M together with the mould base 18 and thereafter the casting is removed from the moulding material, either by tipping the moulding material out of contact with the casting or by fluidising the moulding material to permit it to flow or by other means.

The ingate is then removed from the casting.

Although in the present example, the orifice 13 is formed in a removable insert 14, if desired, the orifice may be formed in other material than insulating refractory material but be lined with insulating refractory material. For example the orifice may be defined in a sleeve of the insulating refractory material provided in an opening in an aluminium plate mounted on, or which itself forms the mould base 18. The insert 14 may be used for a considerable number of casts or replaced after each cast or a small number of casts depending upon the metal being cast and the material of which the orifice is made.

In the present example, the casting ingate is placed directly in casting relationship with the riser tube. If desired, however, in any particular casting where feeding is required to a plurality of locations to ensure that the casting is fed by movement of metal upwardly against the influence of gravity, a plurality of casting ingates may be provided interconnected to a runner system along which the molten metal passes against the force of gravity without any substantial flow downwardly under the influence of gravity, and the runner system itself having a runner ingate which is placed directly in casting relationship with the riser tube.

Alternatively, a plurality of separate castings may be made at the same time by feeding molten metal thereto by a similar feeder system extending from the feeder ingate to a casting ingate of the cavity for each casting. Alternatively, more than one riser tube may be provided to feed the metal to feeder ingates corresponding to the number of riser tubes. Each feeder ingate may comprise also a casting ingate or each feeder ingate may be connected to a plurality of casting ingates by a runner system.

Figure 3:
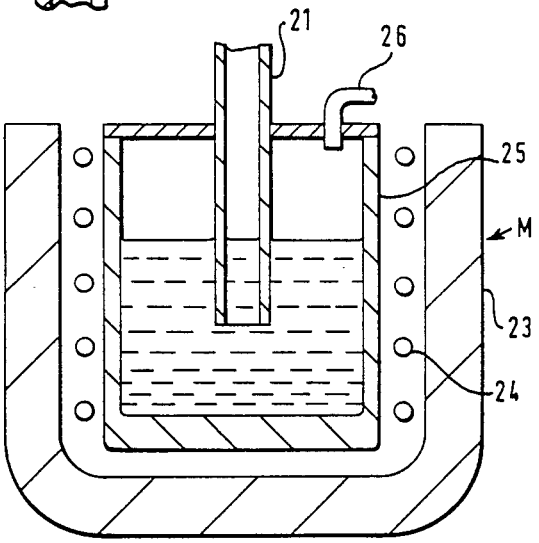
FIG. 3 is a diagrammatic cross-section to a reduced scale through a low pressure casting machine for use with the apparatus shown in FIG. 1.

In the second embodiment of the invention the method, pattern and apparatus are as described in connection with the first embodiment, except that, instead of feeding molten metal into the moulds using the machine shown in FIG. 3, there is used the apparatus shown in FIG. 4.

Figure 4:
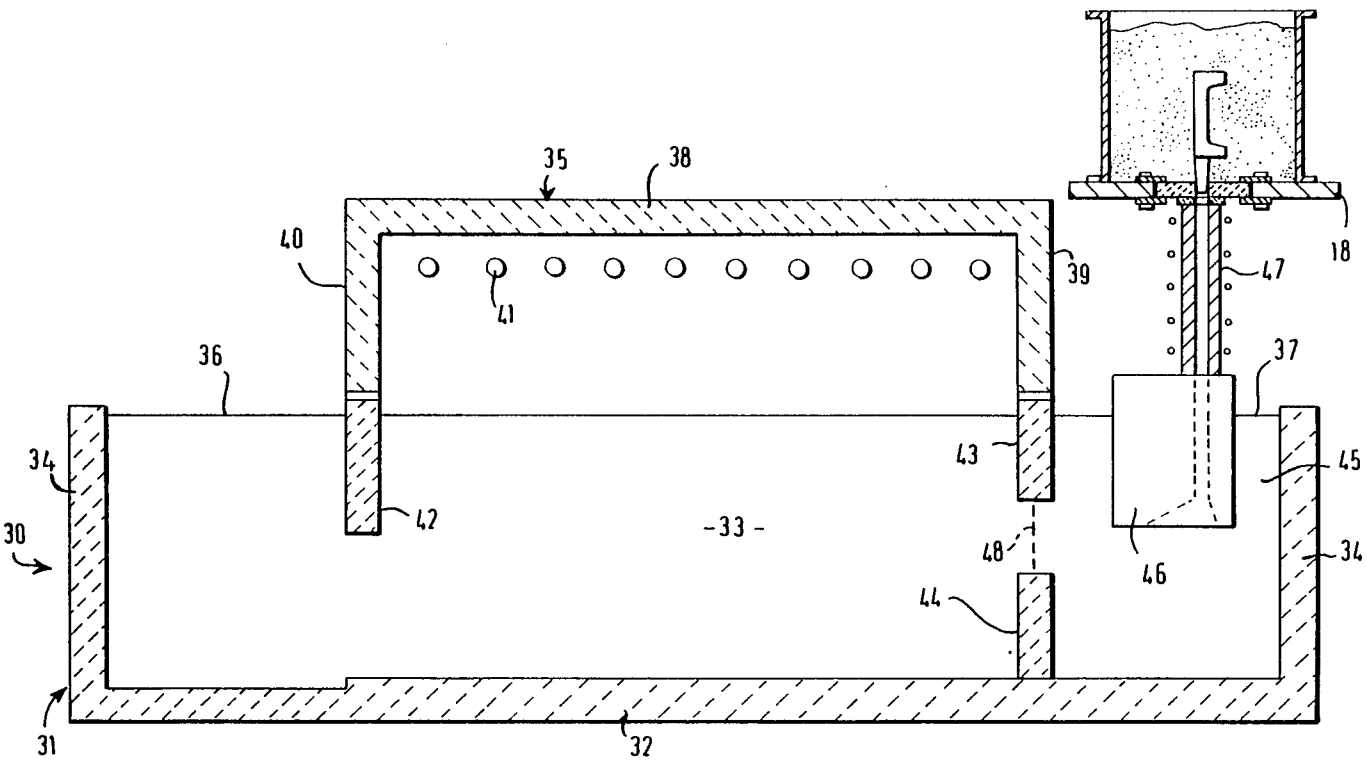
FIG. 4 is a diagrammatic cross-section, to a reduced scale, through a melter/holder furnace for use with the apparatus and pattern of FIGS. 1 and 2 in a second embodiment of the invention.

In this embodiment, referring particularly to FIG. 4, there is provided a melter/holder furnace 30 comprising a refractory lined vessel 31 having a generally rectangular base 32, and vertical side and end walls 33, 34 respectively. A roof 35 extends across the whole width of the vessel 31 but stops short of the end walls 34 to provide a charging wall 36 and a pump well 37 at opposite ends of the vessel.

The roof 35 comprises a generally horizontal rectangular top part 38 and vertical side and end walls 39, 40 respectively. The roof 38 comprises suitable refractory material and within the roof are provided electrical radiant heaters 41.

The temperature of the heaters 41 and the number thereof and the area of the top part 38 of the roof are arranged so as to provide sufficient heat to melt ingots fed into the vessel 31 at the charging well 36 and to maintain the metal molten in the remainder of the vessel. A downwardly depending refractory wall 42 is provided at the charging well end of the vessel 31 to separate the charging well from the main heating part of the vessel whilst downwardly depending and upwardly extending refractory walls 43, 44 are provided at the pump well end of the vessel to define a casting vessel region 45 within which a pump 46 is provided. In the present example the pump 46 is an electro-magnetic pump which pumps metal from the region 45 through a riser tube 47 which is connected to the mould base 18 in exactly the same way as the riser tube 21 shown in FIG. 1. If desired a filter 48 may be provided between the walls 43 and 44 to filter metal entering the casting vessel 45.

The features disclosed in the foregoing description, or the accompanying drawings, expressed in their specific forms or in terms of a means for performing the disclosed function, or a method or process for attaining the disclosed result, may, separately or in any combination of such features, be utilised for realising the invention in diverse forms thereof.

I claim:

1. A method of precision foundry casting metal articles comprising the steps of supporting an in situ destroyable pattern within a container by means of a feed member, the feed member being mounted within the container, then embedding the pattern in unbonded particulate moulding material and consolidating the moulding material around the pattern to form a mould cavity therein occupied by the pattern, then feeding molten metal through the feed member into the mould cavity by pumping the metal generally upwardly against the force of gravity from a reservoir of molten metal which is at a level which is below the level of the cavity through a passage having one end surrounded by the molten metal and an opposite end which is connected to the mould cavity and an intermediate part which extends through the free surface of the molten metal with a pump formed separately from the reservoir and which draws metal from the reservoir into the pump and discharges metal from the pump into the mould cavity, the pump comprising a part of said passage, then permitting the metal to solidify within the cavity and interrupting the feed of said metal and removing the casting from the mould cavity.

2. A method according to claim 1 wherein the paticulate material is consolidated by at least one of vibration and application of a vacuum.

3. A method according to claim 1 wherein the method includes the step of engaging the feed member with a means defining an orifice, said means being fixed relative to the container and providing a passage for flow of metal into the container from the reservoir.

4. A method according to claim 1 wherein the metal to be cast is supplied to the reservoir in molten state from a source of molten metal separate from the reservoir.

5. A method according to claim 1 wherein the metal is fed by an electro-magnetic pump or by a fluid pressure pump.

6. A method according to claim 1 wherein, after the metal has solidified, the level of metal in the passage is lowered below the level of the entry to the mould cavity and thereafter the mould cavity and casting are removed from casting relationship with the reservoir of metal, together with the mould base.

7. A method according to claim 1 wherein the metal is fed into the cavity at the bottom thereof.

8. A method according to claim 1 wherein a pressure below atmospheric pressure is applied to the mould cavity during casting.

9. A method according to claim 1 wherein said feeding of molten metal generally upwardly against the force of gravity from the reservoir into the mould cavity is performed without any substantial flow of metal downwardly under the influence of gravity between the reservoir and the entry into the cavity.

10. A method according to claim 1 wherein the mould cavity is filled by a flow of metal generally upwardly against the force of gravity throughout the mould cavity.

11. A method according to claim 10 wherein the mould cavity is filled without any substantial flow of the metal downwardly under the influence of gravity within the mould cavity.

12. A method according to claim 1 wherein the metal to be cast is supplied to the reservoir by feeding metal in solid state to, and melting the metal in, the reservoir.

13. A method according to claim 12 wherein the reservoir has a feed region whereat said metal is fed into the reservoir in solid state, and a casting region from which metal, in liquid state, is drawn by said pump.

14. A method according to claim 13 wherein the reservoir had a heating region, between the feed region and the casting region in which heat is applied to the metal in the reservoir.

* * * * *